US006068528A

United States Patent [19]

Suzuki

[11] Patent Number: 6,068,528

[45] Date of Patent: May 30, 2000

[54] WATERCRAFT ENGINE CONTROL

[75] Inventor: Akitaka Suzuki, Iwata, Japan

[73] Assignee: Yamaha Hatsudoki Kabushiki Kaisha, Iwata, Japan

[21] Appl. No.: 09/161,808

[22] Filed: Sep. 28, 1998

[30] Foreign Application Priority Data

Sep. 26, 1997 [JP] Japan ..... 9-262299

[51] Int. Cl.[7] ..... B63H 21/22

[52] U.S. Cl. ..... 440/1; 440/84; 440/87; 440/89

[58] Field of Search ..... 440/1, 2, 88, 89, 440/84, 87, 900

[56] References Cited

U.S. PATENT DOCUMENTS 5,554,057 9/1996 Abe et al. ..... 440/89
5,797,775 8/1998 Ozawa et al. ..... 440/1

*Primary Examiner*—Stephen Avila
*Attorney, Agent, or Firm*—Knobbe, Martens, Olson & Bear LLP

[57] ABSTRACT

A personal watercraft catalytic exhaust system wherein an over-temperature sensor is provided that is effective to shut down the engine in the event the catalyst reaches a dangerous temperature. The engine, once shutdown, cannot be restarted until the temperature falls below a predetermined temperature which may be lower than the overheat temperature. In the process of stopping the engine, it is slowed down first so as to give the rider additional warning that the shutdown procedure will be initiated.

10 Claims, 8 Drawing Sheets

WATERCRAFT ENGINE CONTROL

BACKGROUND OF THE INVENTION

This invention relates to a small personal type watercraft and more particularly to an improved engine control for such a type of watercraft.

The field of so-called "personal watercraft" is one that is growing rapidly. However, due to the large number of such watercraft, there is a concern for improving environmental protection by implementing engine controls for such watercraft. In many instances, catalytic treatment is desirable for the watercraft engine, particularly when the engine is of the two-cycle, crankcase compression type.

Because of its very nature, however, the small confined space available for the propulsion unit in such watercraft gives rise to certain problems. As is well known, the catalyst must be at or above a specific temperature in order to operate efficiently. However, under some operating conditions, the temperature of the catalyst may become quite elevated, particularly when large amounts of exhaust gases having high amounts of unburned hydrocarbons must be treated. This provides certain problems in connection with heat control.

Although the heat or temperature of the catalyst can be controlled and is controlled by water-jacketing the catalyst, too high a cooling of the catalyst can result in its operation at temperatures less than those required in order to be effective. Thus, the amount of cooling provided should be limited so as to avoid over-cooling of the catalyst. This further aggravates the problem of preventing excess temperatures.

It is, therefore, a principal object of this invention to provide an improved control arrangement for the engine of a personal watercraft having a catalytic converter.

It is a further object of this invention to provide an improved catalytic converter control arrangement for a personal watercraft wherein overheating conditions can be avoided.

It may be desirable in order to provide effective control to incorporate an arrangement wherein the engine of the watercraft is slowed or stopped if the temperature of the converter becomes too high. However, merely stopping the engine does not totally avoid these potential problems.

For example, the watercraft may be shut down and then the operator can again restart the watercraft engine. Since starting techniques frequently provide richer than normal mixtures, further aggravation of the overheated condition of the catalyst can occur if the engine is started again too soon after shutdown.

It is, therefore, a further object of this invention to provide an improved temperature control system for the catalytic exhaust of a personal watercraft wherein restarting of the engine after shutdown is not permitted until the catalyst reaches a safe temperature.

In conjunction with the shutting down of the engine to prevent damage due to catalyst overheating, if the engine is abruptly stopped, certain other ancillary problems may arise. Also, this may fail to give the operator warning of shutdown among other problems.

It is, therefore, a further object of this invention to provide an improved shutdown procedure for a catalytic exhaust system of a personal watercraft.

SUMMARY OF THE INVENTION

This invention is adapted to be embodied in a personal watercraft having a hull in which an engine is mounted. The engine drives a propulsion devices for propelling the personal watercraft through a body of water. The engine is provided with an exhaust system for discharging exhaust gases from the combustion chamber of the engine to the atmosphere. This exhaust system includes a catalyst bed through which the exhaust gases are passed for treating the exhaust products and removing harmful constituents. An arrangement is provided that incorporates a starting system for starting the engine and also a sensing arrangement senses the temperature of the catalyst.

In accordance with a first feature of the invention, an engine shutdown procedure is initiated if the catalyst is at a temperature that is greater than a predetermined temperature. Once the shutdown procedure is initiated, the engine cannot be restarted until the catalyst temperature falls below a predetermined lower safe value.

In accordance with another feature of the invention, the shutdown procedure is comprised of initially slowing the engine and then stopping the engine after it is slowed sufficiently so as to give the operator notification or warning of the shutdown.

DETAILED DESCRIPTION OF THE PREFERRED EMBODIMENTS

Figure 1:
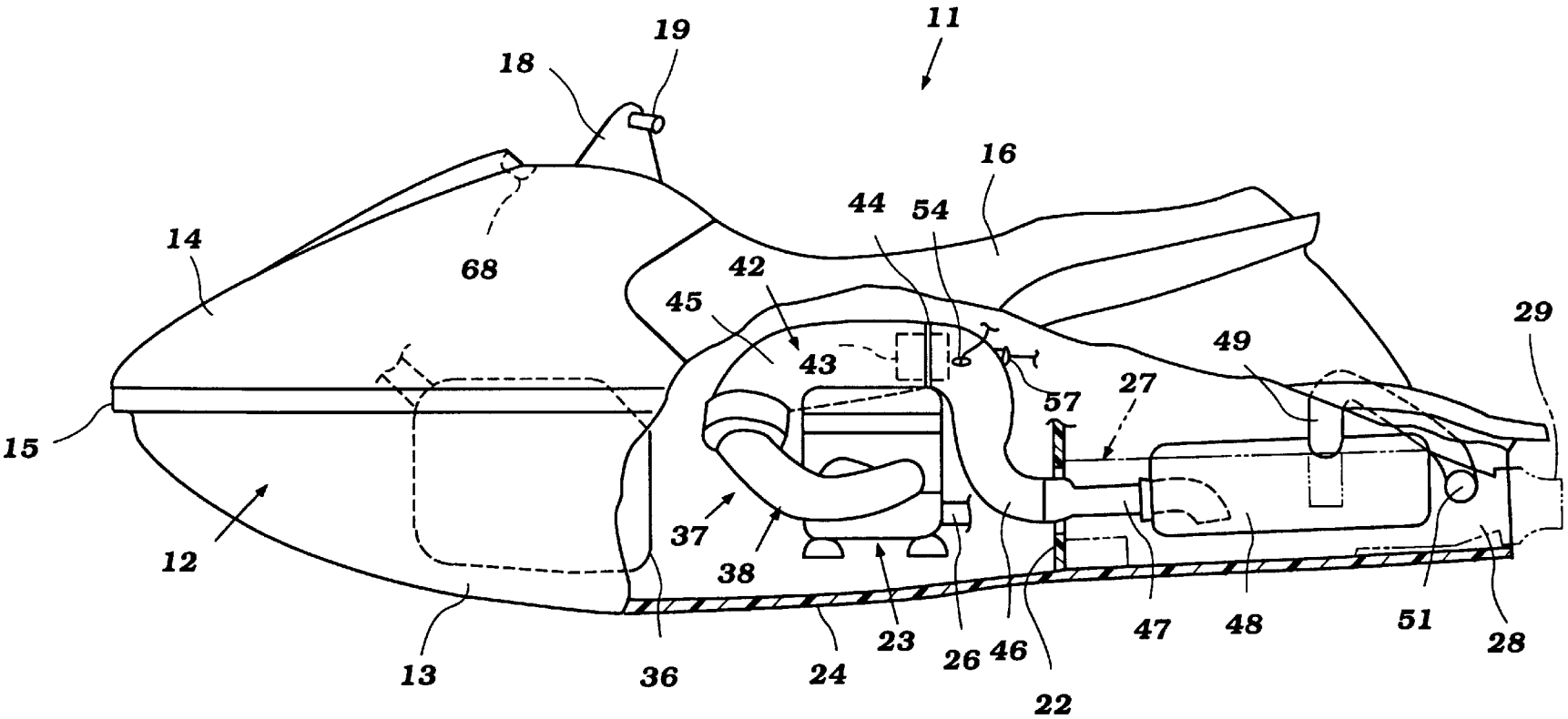
FIG. 1 is a side elevational view of a personal watercraft constructed in accordance with an embodiment of the invention, with a portion broken away to show the propulsion system.
Figure 2:
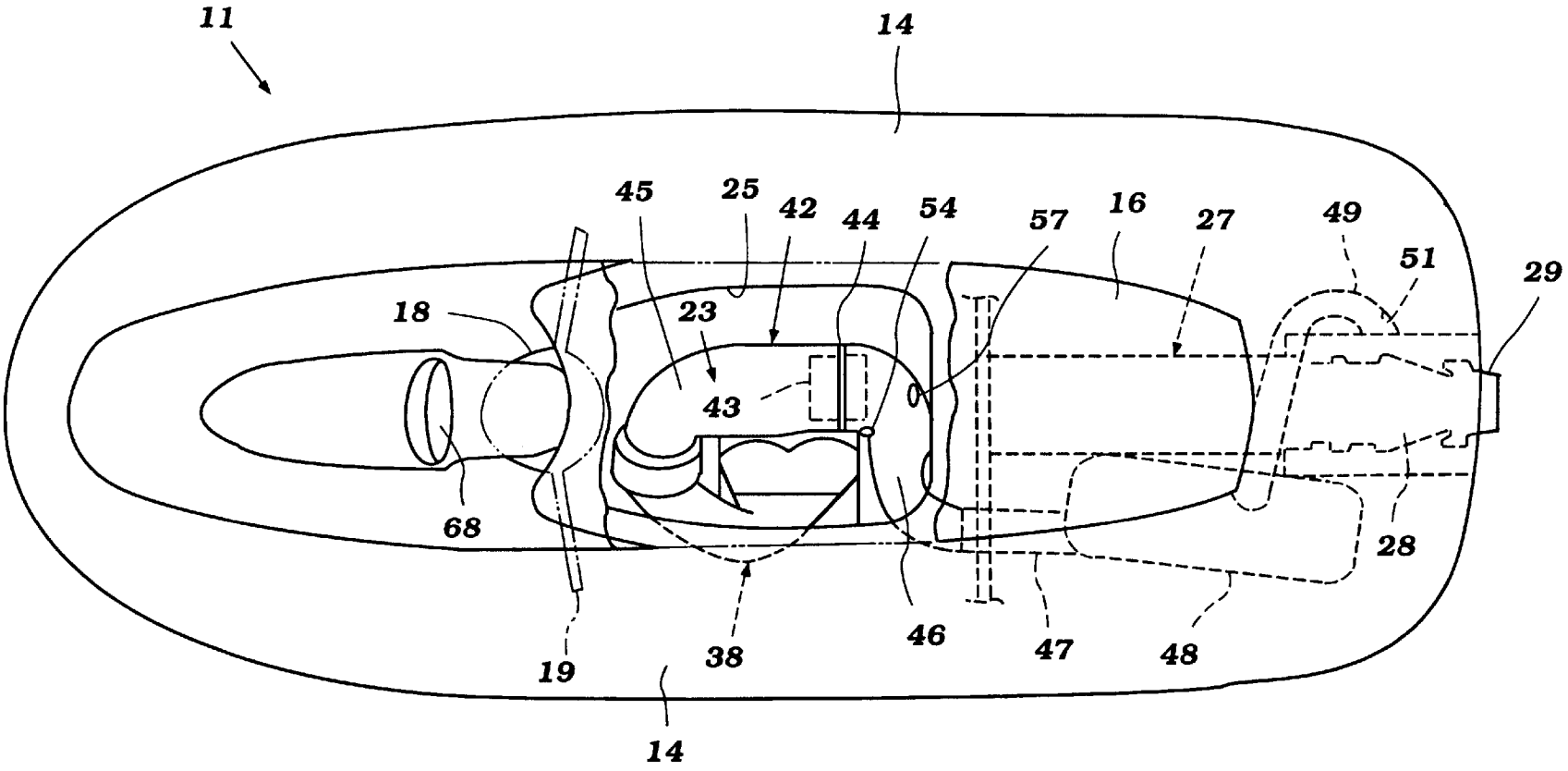
FIG. 2 is a top plan view of the watercraft with a further portion broken away so as to show the propulsion system.
Figure 3:
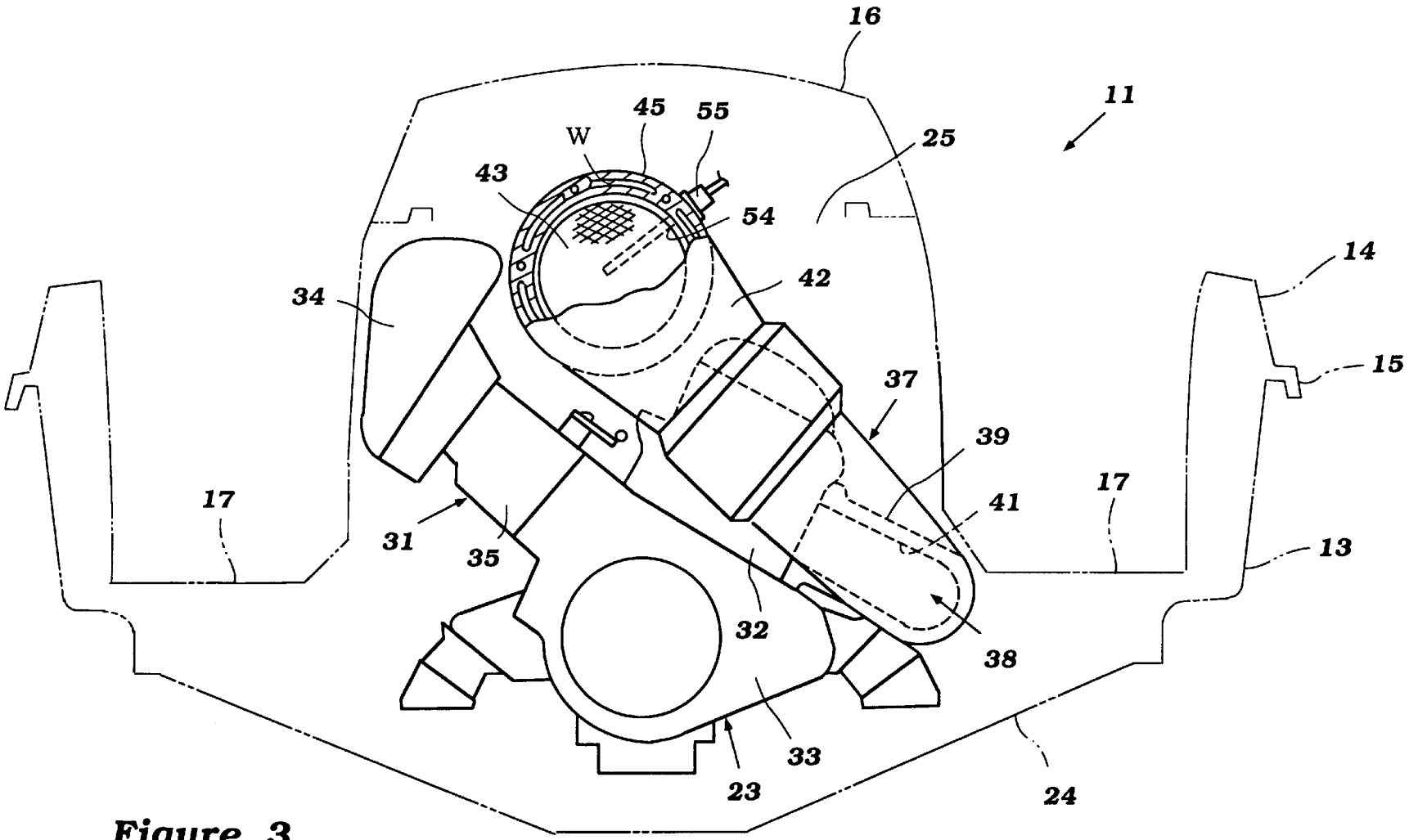
FIG. 3 is an enlarged front view, in part cross-sectional in nature, taken through the engine compartment of the watercraft and showing the watercraft hull in phantom and the engine in solid lines with a portion of the exhaust system broken away and shown in section.

Referring now in detail to the drawings and initially primarily to FIGS. 1–3, a personal watercraft constructed in accordance with an embodiment of the invention is indicated generally by the reference numeral 11. The term "personal watercraft" is intended to describe a relatively small type of watercraft having a generally sporting nature and designed primarily for operation by a single rider and accommodating one or more passengers. By its very nature, the personal watercraft such as the watercraft 11 is quite compact in nature and this gives rise to the potential difficulties as aforenoted. A specific type of personal watercraft is illustrated and will be described, but it should be readily apparent to those skilled in the art how the invention can be practiced with personal watercraft of other configurations and types.

The watercraft 11 is comprised of a hull assembly, indicated generally by the reference numeral 12, which is comprised primarily of a hull underpart 13 and a deck 14. The hull parts 13 and 14 are preferably formed from a molded fiberglass reinforced resin or the like, and are secured to each other around their outer periphery at a gunnel area 15.

The deck portion 14 is formed at its rearward end with a rider's area. This rider's area is comprised of a raised seat portion 16 on which the rider and passengers may be seated in a straddle fashion and in tandem relationship if more than one person occupies the watercraft 11. On opposite sides of the raised seat portion 16, there are provided depressed foot areas 17 wherein the seated riders may place their feet. As is typical with this type of watercraft, the foot area 17 may open through the transom of the watercraft to facilitate entry and exit while the watercraft 11 is floating in a body of water.

A control mast 18 is provided forwardly of the seat 16 and carries a handlebar assembly 19 for control of the watercraft in a manner which is well known in the art and which will be described to some extent later.

In the area below the rider's area, as is typical with the personal type watercraft of this nature, the hull and deck portions 13 and 14 define an engine compartment 21 which is delimited at its rear end by a bulkhead 22. An internal combustion engine, indicated generally by the reference numeral 23, is supported on a lower part 24 of the hull portion 13 within the engine compartment 21. As may be best seen in FIG. 2, the seat portion 16 has a removable part which, when removed, opens an access opening 25 through which the engine 23 may be serviced.

In the illustrated embodiment, the engine 23 is of the two-cycle, crankcase compression type and is depicted as being of the inline type. Although the invention is described in conjunction with such an engine, as should be apparent from the following description, the various features of the invention can be utilized in combination with engines of other types and other than two-cycle engines.

The engine 23 is mounted in the hull engine compartment and has an output shaft 26 that is coupled to the impeller shaft of a jet propulsion unit, indicated generally by the reference numeral 27, and positioned on the underside of the hull portion 13 rearwardly of the bulkhead 22.

This jet propulsion unit 27 has a downwardly facing water inlet opening through which water is drawn under the action of an impeller driven by the engine output shaft 26. This water is then discharged rearwardly through a discharge nozzle portion 28 to provide a propulsive force for the associated watercraft hull 12. A pivotally supported steering nozzle 29 is mounted on the end of the discharge nozzle portion 28 and is controlled by the handlebar 19 for steering of the watercraft in a manner well known in this art.

Still referring primarily to FIGS. 1–3, the engine 23 is provided with an induction system, indicated generally by the reference numeral 31, and which supplies an air fuel charge to the crankcase chambers of the engine 23. These crankcase chambers are formed below a cylinder block 32 which is inclined to the vertical as best seen in FIG. 3 to permit a more compact construction and still afford easy access to the various engine components.

The induction system 31 communicates with a crankcase assembly 33 and includes an air inlet device 34. The air inlet device 34 collects air from within the interior of the engine compartment and delivers it to a charge former such as one or more carburetors 35. The carburetors 35 communicate with intake ports in the crankcase chamber 33 for delivering the fuel air charge thereto.

Fuel is supplied to the carburetor 35 or such other charge formers as the engine may employ from a fuel tank 36 that is positioned in the hull forwardly of the engine 23. The fuel supply system may be of any known type.

The fuel air charge which has been delivered to the crankcase chambers is transferred to the combustion chambers through a scavenge system of any known type and further compressed above the pistons as they move toward top dead center. This charge is fired at an appropriate time by an ignition system which is not shown, but which may be controlled in a manner as will hereinafter be described. The exhaust gases are then discharged to the atmosphere through an exhaust system, indicated generally by the reference numeral 37.

This exhaust system 37 includes an exhaust manifold 38 which has individual branch or collector sections 39 that communicate with the exhaust ports formed in the cylinder block 32 for collecting the exhaust gases and delivering them through runner sections 41 to a collector section formed in an expansion chamber portion of the exhaust manifold 38. The exhaust manifold 38 communicates with a further expansion chamber device, indicated generally by the reference numeral 42, and which includes a catalyst bed assembly 43 that is mounted on a support plate 44 held between a forward section 45 and a rearward section 46 of the expansion chamber device 42. This catalyst bed 43 may be of any desirable or known type so as to treat the exhaust gases to remove the desired harmful constituents therefrom.

The expansion chamber portion 46 has a downwardly extending part that extends downwardly at a point to the rear of the engine 23 where it is connected to an exhaust pipe 47. The exhaust pipe 47 terminates in a water trap device 48 that is provided in the hull portion 13 on one side of the tunnel that receives the jet propulsion unit 27 as best seen in FIGS. 1 and 2.

An exhaust discharge pipe 49 extends from the water trap device upwardly and transversely across the upper portion of the jet propulsion unit 48 to terminate at a discharge end 51 that communicates with a tunnel formed in the hull undersurface adjacent the jet propulsion unit discharge nozzle 28.

It should be noted that the portion of the watercraft 11 as thus far described including the engine 23 and the general nature of the exhaust system 37 is only to permit those skilled in the art to understand the environment in which the invention is utilized. The invention deals primarily with a construction for monitoring the condition of the catalyst bed assembly 43 as well as the temperature downstream of the bed assembly 43 and controlling the engine 23 under certain abnormal conditions. Therefore, the portions of the construction as thus far described has been described and illustrated only generally. It will be readily apparent to those skilled in the art how the invention can be practiced with any desired type of structure.

The mounting of the catalyst bed assembly 43 and the construction of the catalyst bed will now be described in more detail by more reference first to FIGS. 4–6. It may be seen that the catalyst bed assembly 43 includes, in addition to the mounting plate 44, a tubular member 52 that is generally co-extensive with the interior diameter of the joined outer housing portions 45 and 46. These outer housing members have a double wall construction so as to provide a water jacket W to which cooling water from the engine is delivered. This water may be delivered also through similar water jacketing in the exhaust manifold 38 or through external conduitry.

A honeycomb-type structure 53 is provided within the shell 52 and is coated with the appropriate catalytic material so as to treat the exhaust gases as they flow through the exhaust system. The mounting plate 44 also has water opening holes W so that the water jackets of the members 45 and 46 can communicate with each other.

A temperature sensor probe 54, which may comprise a thermocouple-type device, is mounted by means of a mounting base 55 on the housing member 46 so that the probe 54 protrudes into the area immediately downstream of the catalyst bed 53. An output from this temperature sensor 54 is transmitted to a controller 56 (FIG. 7), which may comprise an ECU for motor control and which performs the control strategy for operating the engine 23 and its various systems including the over-temperature system which will be described shortly. The output from the sensor probe 54 is not employed, however, for this particular over-temperature protection in the illustrated embodiment, although this is possible.

An over-temperature sensor, indicated generally by the reference numeral 57, is mounted in the housing member 46 in line with a centerline CL of the flow path through the honeycomb bed 53 so that it will be directly impacted by the exhaust gases flowing through an internal passageway 58 formed by the inner shell of the member 46. The output from this sensor 57 is also outputted to the ECU 56.

Figure 7:
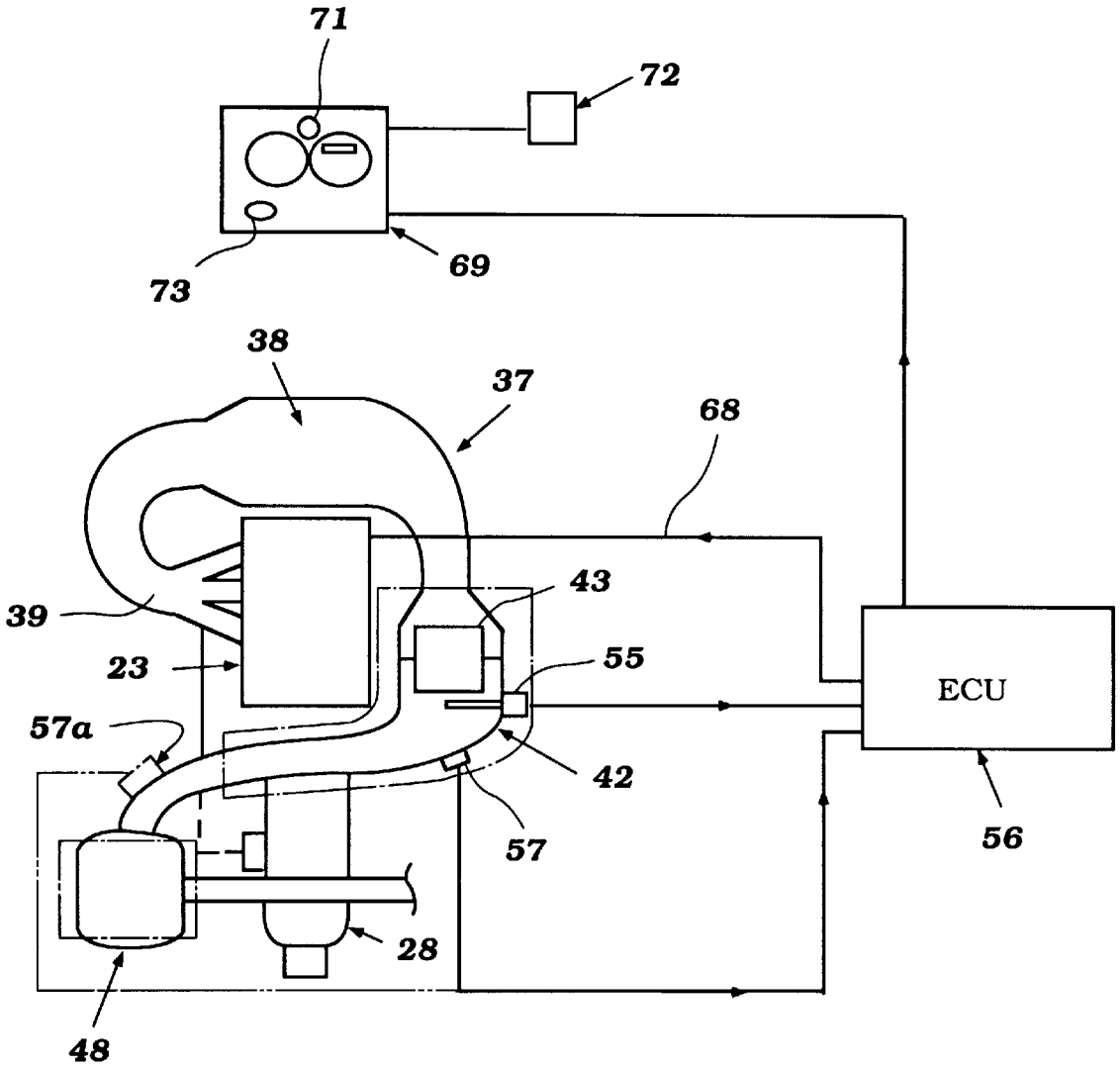
FIG. 7 is a schematic view showing the engine and the control and warning arrangement associated therewith.

Although this location is a preferred location for the over temperature indicator 57, it may also be located at other places along the exhaust system downstream of the catalyst bed 43. For example and as shown in FIG. 4, the high temperature or over-temperature sensor 57 may be located at the alternative location 57*a* at the point where the expansion chamber catalyst bed housing section 46 joins with the exhaust pipe 47. This alternative location is also shown in FIG. 7 by a like designation.

A fitting 59 is placed in the housing section 46 in a downstream location. The fitting 59 is adapted to receive a sampling tube 61 so that exhaust gas sampling may be done to determine the efficiency of the catalytic system.

Figure 4:
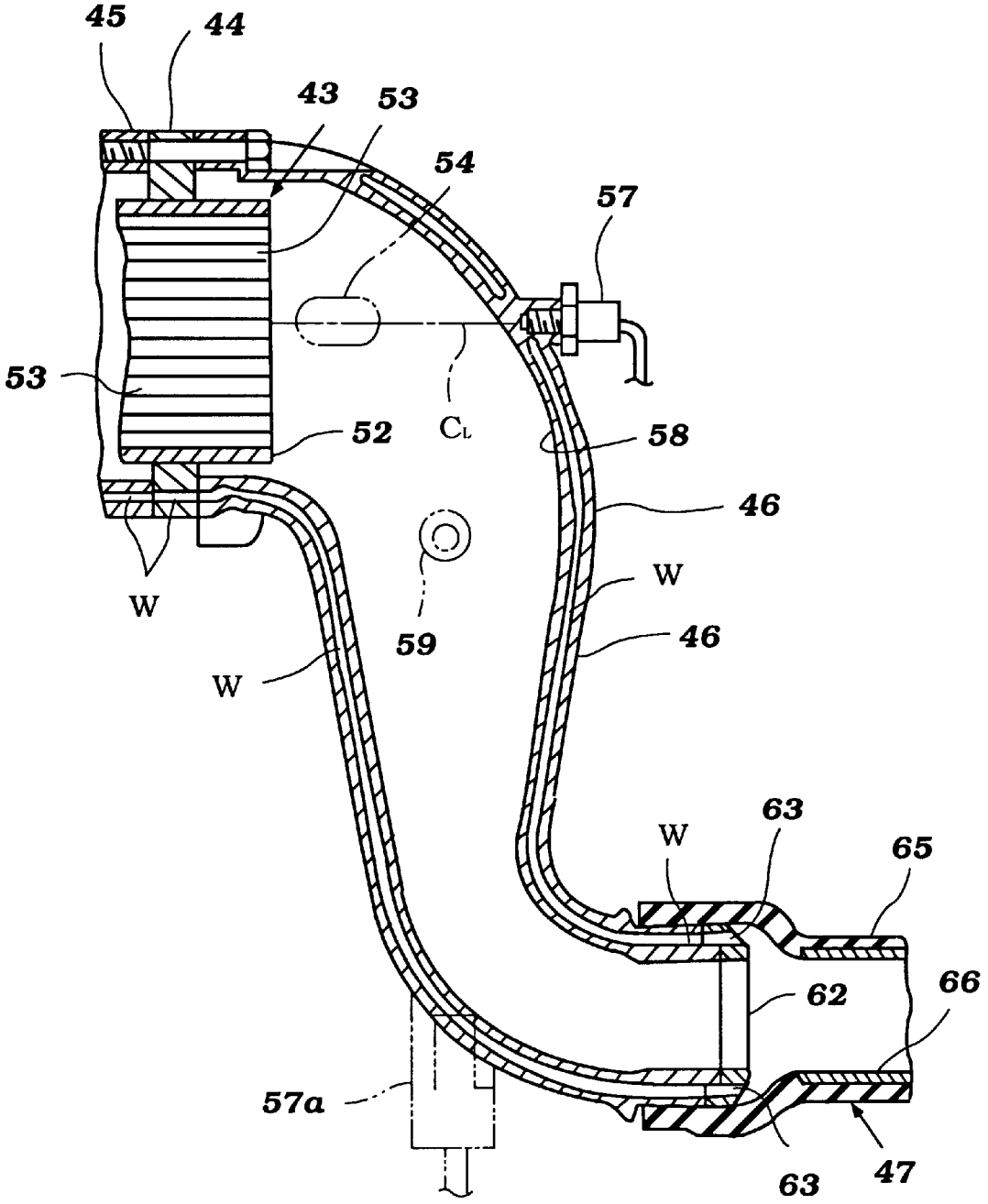
FIG. 4 is a cross-sectional view of the portion of the exhaust system that appears in FIG. 3.
Figure 5:
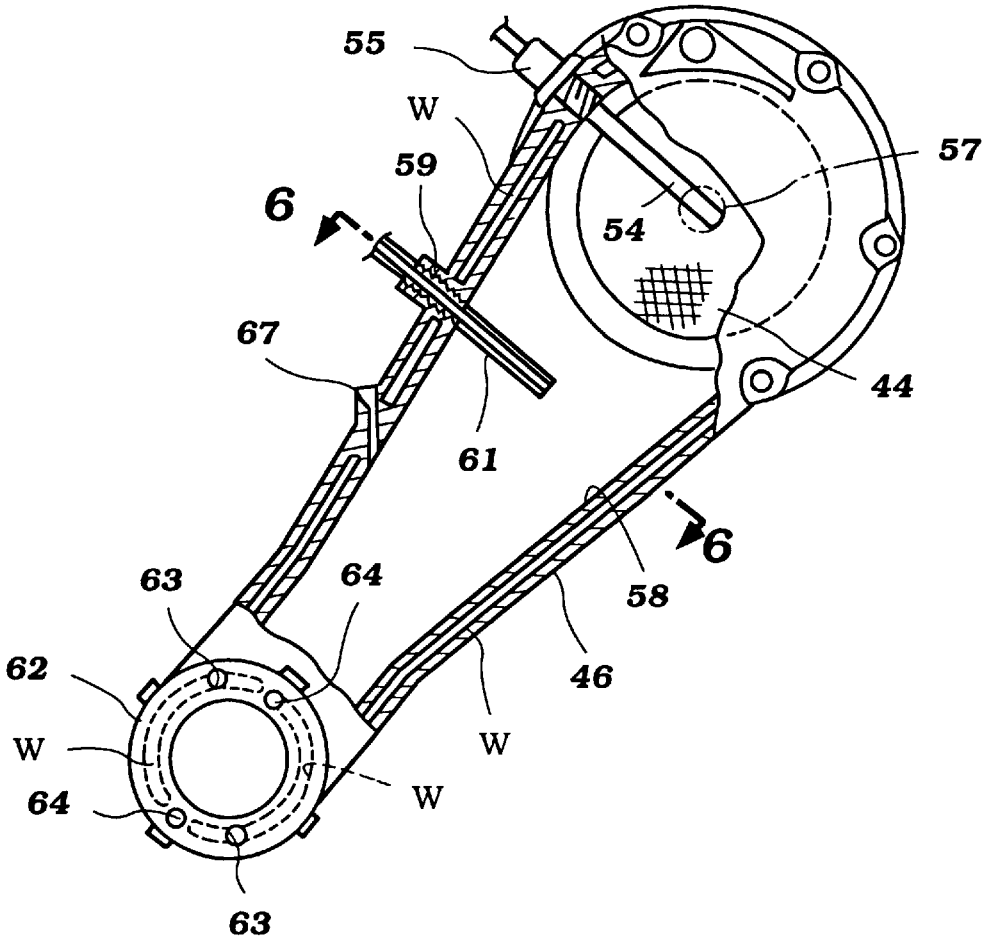
FIG. 5 is a view looking in the opposite direction from FIG. 3 and shows the same portion of the exhaust system, with portions broken away and shown in section.
Figure 6:
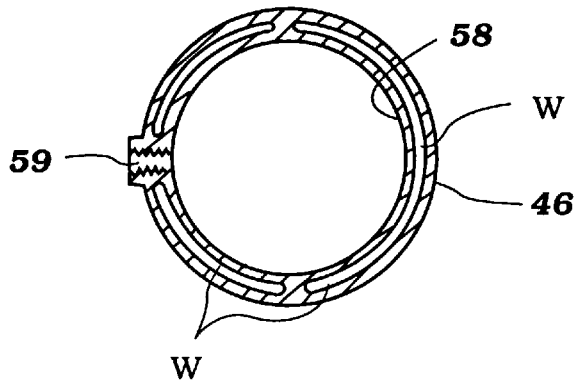

As may be best seen in FIGS. 4 and 5, the lower end of the housing member 46 that joins with the tail pipe 47 is closed by a member 62 that has a plurality of circumferentially spaced openings 63 which allow the water to flow from the water jacket W through an open end of the housing member 46 into the interior of the exhaust pipe 47. This member 62 is held in place by threaded fasteners 64.

It should be noted that the exhaust pipe 47 is comprised of an outer elastic member 65 and an inner heat-protecting aluminum sleeve 66. Thus, vibration can be absorbed while the exhaust gases will not attack the elastomeric member 65. Also, since the cooling water is mixed with exhaust gases at this point, the temperature will be lowered so as to avoid damage. In order to cool the exhaust gasses without excessively cooling the catalyst bed assembly, cooling water that has not passed through the engine cooling jackets through a fresh water inlet port 67 in the housing member 46 down stream from the catalyst bed assembly 43 (FIG. 5).

Figure 8:
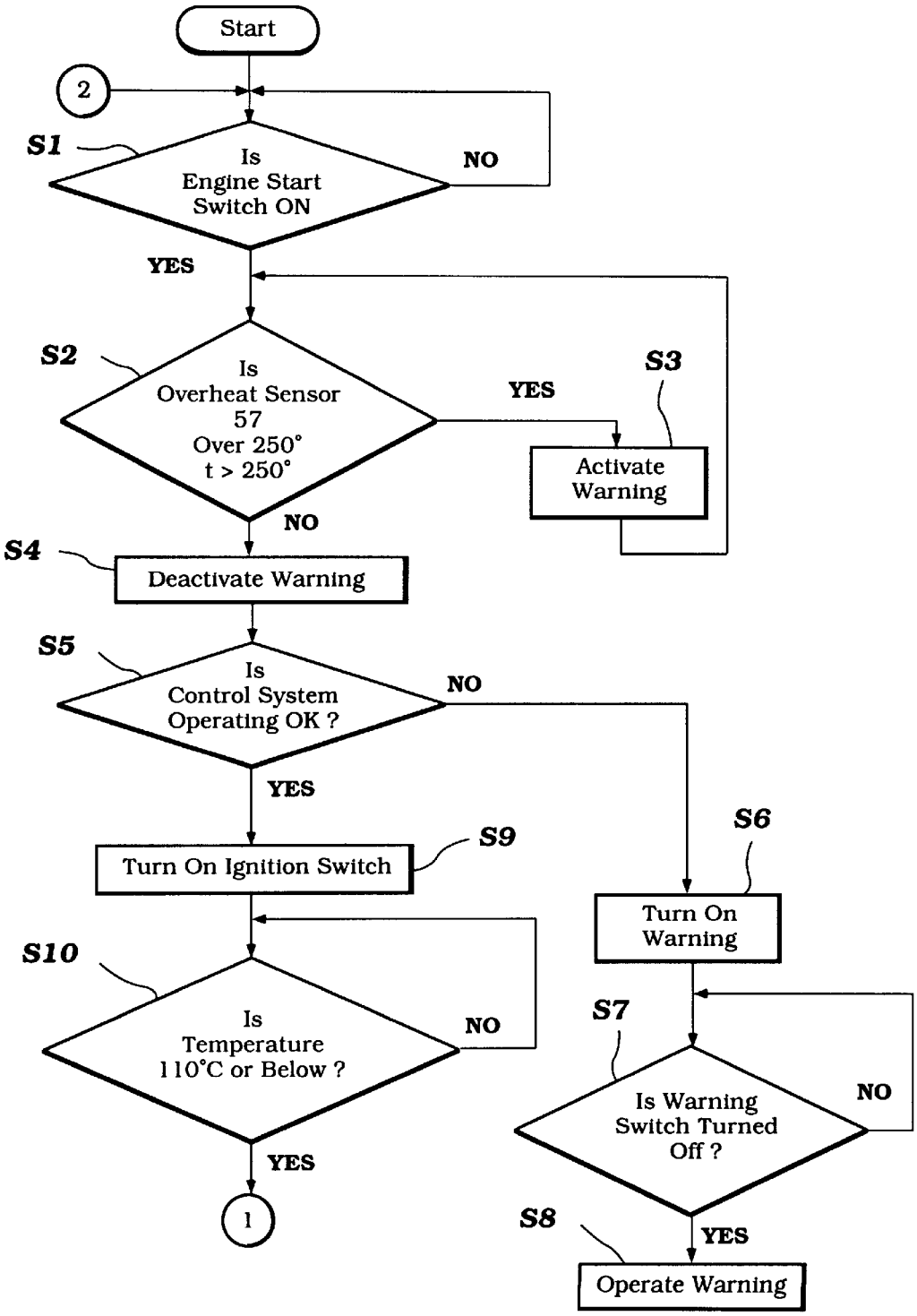
FIG. 8 is a block diagram showing a first portion of the control routine.
Figure 9:
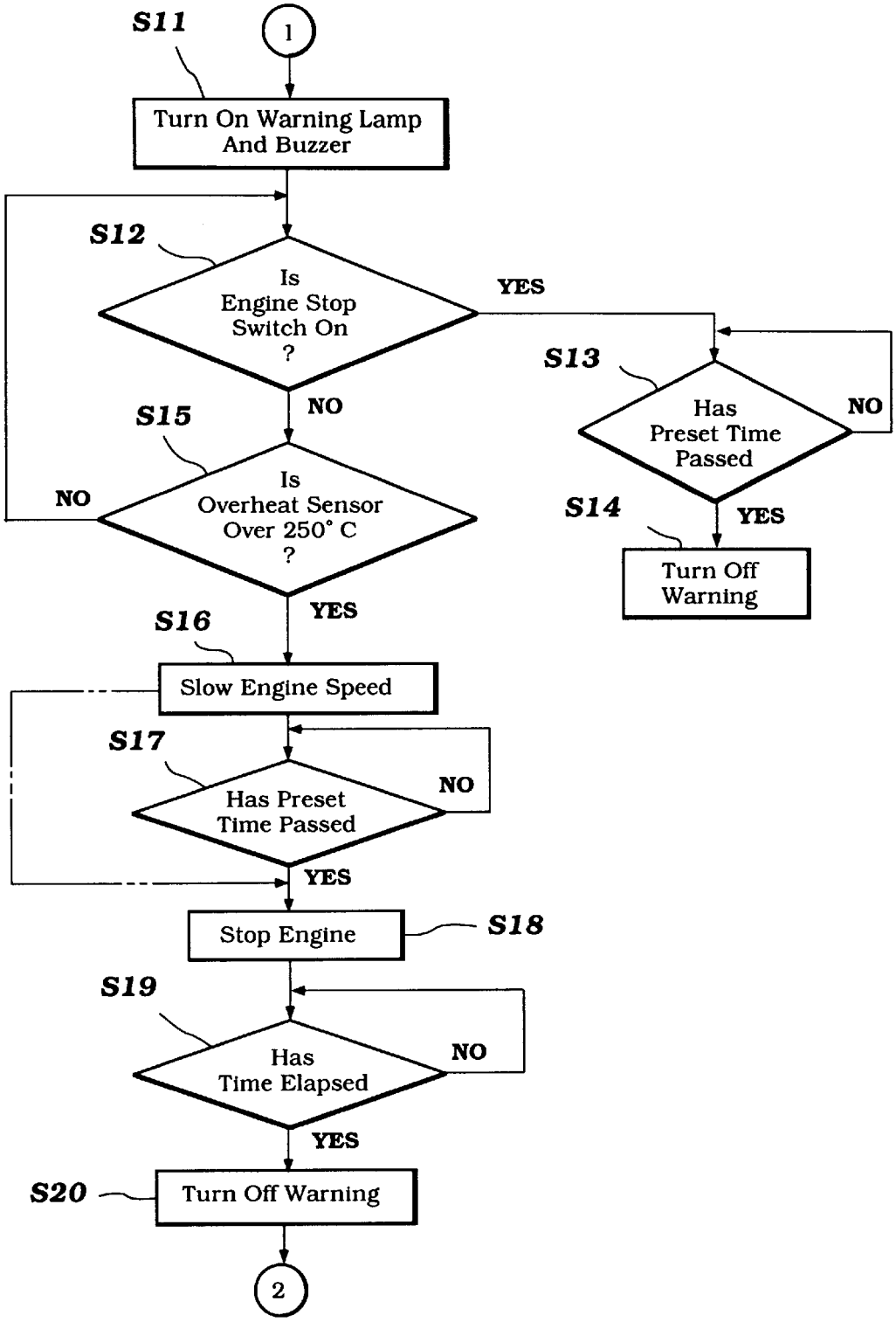
FIG. 9 is a block diagram showing the remaining portion of the control routine.

Referring now primarily to FIGS. 7–9, it has been noted that the signals from the temperature sensor 54 and the over-temperature sensor 57 are transmitted to the ECU 56. The ECU 56 also receives various other information from engine and ambient sensors for engine control and outputs a signal through a conductor 68 to the ignition circuit of the engine among other things.

Also, a control panel 69 is mounted forwardly of the control mast 18 and handlebar 19 as seen also in FIG. 1 to display certain information to the operator. This display 68 can include an over-temperature warning light 71 and/or temperature gauge and an over temperature warning buzzer 72.

Basically, the control strategy for the system, which will be described momentarily by reference to FIGS. 8 and 9, is such that if the temperature sensed by the overheat sensor 57 exceeds a predetermined relatively high temperature, for example a temperature in the range of about 250° C., a protective routine is initiated. This protective routine includes the step of first slowing the engine 23 if it is operating at any elevated speed by misfiring the spark plugs. This will give the operator a physical warning that the overheat condition is existent and also will notify that the engine 23 will be shut down shortly. At the same time, the warning light 71 is illuminated and the warning buzzer 72 is sounded. Then, the engine will be stopped.

In addition to stopping the engine, the starting circuit for the engine which includes a starter button 73 on the control panel 69 will be disabled so that the engine cannot be restarted until the temperature of the overhead sensor 57 falls to a predetermined lower temperature such as a temperature in the range of about 100° C.

This control routine will now be described by reference to FIGS. 8 and 9. Starting first with FIG. 8, the program starts at the step S1 to determine if the engine start switch or starter button 73 has been depressed to actuate a starter motor (not shown). If it has, the program moves ahead and if not, it repeats.

Assuming the starter button has been depressed, the program moves to the step S2 to determine if the temperature of the overheat sensor 57 is over 250° C. If it is, the program moves to the step S3 to activate the warning and repeats back. Thus, the operator will be warned that the catalyst is over-temperature condition and he will not be able to start the engine.

If, however, the temperature sensor has fallen below the dangerous temperature which is, for example, assumed to be 250° C., the program moves to the step S4 to deactivate the warning.

The program then moves to the step S5 to perform a self-checking function to determine if the system is operating properly. If it is not, the program moves to the step S6 to turn the warning on. The warning arrangement may be provided with a bypass switch that precludes its actuation and at the step S7, it is determined if this switch is turned off. If it is not, the program repeats. If it is, however, at the step S8 the warning is deactivated.

If at the step S5 it is determined that a control system is operating acceptably, the program moves onto the step S9 which, in essence, involve turning on the ignition switch.

Once the ignition switch is turned on, the program moves to the step S10 to determine if the temperature of the over head sensor has fallen to 110° C. or below. If it has not, the program merely repeats.

Once the temperature has dropped below 110° C., then the program moves to the next phase of the control routine which appears in FIG. 9.

At the step S11, the warning lamp and warning buzzer are turned on. This is just done as a self-checking function so that the operator can ascertain that the warning system is operative.

The program then moves to the step S12 to determine if the engine stop or kill switch is turned on. If it is, the program moves to the step S13 to determine if a preset time period has passed. If it has not, the program repeats. If it has, however, then the warning light is turned off. In other words, once the warning has been established, it will remain on for a predetermined time period even after the system is shut down.

Returning again to the step S12, if the engine stop switch is not on, then the program moves to the step S15. At this step, it is determined if the overheat sensor's temperature is above 250° C. If it is not, the program repeats back to the step S12 and the system functions normally until the stop switch is turned on or until the temperature exceeds 250° C. at the step S15.

When the temperature exceeds 250° C., then the program moves to the step S16 to initiate a slowing of the engine speed. This is done, as aforenoted, by misfiring the spark plugs.

In accordance with one control routine, the engine speed is permitted to operate at a slower speed for a time period which is preset. At the step S17, it is determined if this time period has elapsed. If it has not, the program repeats. If it has, however, then the program moves to the step S18 and stops the engine.

It should be noted that in an alternative control routine, the program may move directly from the step S16 to the step S18 as shown by the phantom line in FIG. 9.

Once the engine is stopped, then the program starts a timer running and at the step S19 determines if that time has elapsed. If it has not, the warning light is left on. If, however, the time has elapsed, then at the step S20, the warning is turned off.

Thus, from the foregoing description, it should be readily apparent that the arrangement is such that at any time either during starting or when the engine is running and the temperature exceeds 250° C. or whatever predetermined dangerously high temperature is chosen for the system, the engine will be stopped preceded by a slowing of the engine speed, although that step may be skipped if desired. However, once the condition has been exceeded and the engine stopped, it cannot be restarted until the temperature falls below that high temperature and in a preferred embodiment below a lower temperature such as 110° C.

Of course, it should be understood that the foregoing description is that of the preferred embodiment of the invention. Various changes and modifications may be made without departing from the spirit and scope of the invention, as defined by the appended claims.

I claim:

1. A personal watercraft having a hull in which an engine is mounted, said engine driving a propulsion device carried by said hull for propelling said personal watercraft through a body of water, said engine being provided with an exhaust system for discharging exhaust gases from a combustion chamber of said engine to the atmosphere, said exhaust system including a catalyst bed through which the exhaust gases are passed for treating the exhaust products and removing harmful constituents, a starting system for starting said engine, a sensor for sensing the temperature downstream of said catalyst bed, and means for initiating an engine shutdown procedure if said sensor senses that the temperature that is greater than a predetermined temperature and for precluding said engine from being restarted any condition until said sensed temperature falls below a predetermined, lower safe value.

2. The personal watercraft as set forth in claim 1, wherein the shutdown procedure comprises slowing of the engine.

3. The personal watercraft as set forth in claim 2, wherein the shutdown procedure further comprises stopping of the engine after the slowing.

4. The personal watercraft as set forth in claim 1, wherein the shutdown procedure comprises stopping of the engine.

5. The personal watercraft as set forth in claim 1, wherein the shutdown procedure further comprises giving a warning at the time the catalyst temperature is greater than the predetermined temperature.

6. The personal watercraft as set forth in claim 5, wherein the warning is continued for a predetermined time after the shutdown procedure is completed.

7. The personal watercraft as set forth in claim 6, wherein the shutdown procedure comprises slowing of the engine.

8. The personal watercraft as set forth in claim 7, wherein the shutdown procedure further comprises stopping of the engine after the slowing.

9. The personal watercraft as set forth in claim 6, wherein the shutdown procedure comprises stopping of the engine.

10. The personal watercraft as set forth in claim 1 wherein the hull defines a riders area having a seat on which a rider may sit in straddle fashion and the catalyst bed is located below the seat.

* * * * *